US007337832B2

(12) United States Patent
Hu

(10) Patent No.: US 7,337,832 B2
(45) Date of Patent: Mar. 4, 2008

(54) HEAT EXCHANGER

(75) Inventor: Zaiqian Hu, Carmel, IN (US)

(73) Assignee: Valeo, Inc., Auburn Hills, MI (US)

( * ) Notice: Subject to any disclaimer, the term of this patent is extended or adjusted under 35 U.S.C. 154(b) by 340 days.

(21) Appl. No.: 10/425,348

(22) Filed: Apr. 30, 2003

(65) Prior Publication Data

US 2004/0216863 A1 Nov. 4, 2004

(51) Int. Cl.
*F28D 1/00* (2006.01)
*F28F 1/00* (2006.01)

(52) U.S. Cl. ..... 165/140; 165/148; 165/173; 165/176

(58) Field of Classification Search ..... 165/140, 165/148, 174, 176, 144, 173, 175, 177
See application file for complete search history.

(56) References Cited

U.S. PATENT DOCUMENTS

| | | | | |
|---|---|---|---|---|
| 2,037,845 | A | 4/1936 | Young | |
| 2,505,790 | A | 5/1950 | Panthofer | |
| 3,300,135 | A | 1/1967 | Slater et al. | |
| 3,554,440 | A | 1/1971 | Austin et al. | |
| 3,818,981 | A | 6/1974 | Caldwell | |
| 3,920,067 | A | 11/1975 | Schindler et al. | |
| 3,939,901 | A * | 2/1976 | Cieszko et al. | 165/176 |
| 4,669,532 | A | 6/1987 | Tejima et al. | |
| 4,998,580 | A | 3/1991 | Guntly et al. | |
| 5,036,911 | A | 8/1991 | So et al. | |
| 5,526,873 | A | 6/1996 | Marsais et al. | |
| 5,575,329 | A | 11/1996 | So et al. | |
| 5,682,944 | A * | 11/1997 | Yamamoto et al. | 165/110 |
| 6,003,592 | A | 12/1999 | Ryouichi et al. | |
| 6,082,447 | A | 7/2000 | Insalaco et al. | |
| 6,119,340 | A | 9/2000 | Insalaco et al. | |
| 6,158,500 | A | 12/2000 | Heine | |
| 6,161,614 | A | 12/2000 | Woodhull, Jr. et al. | |
| 6,253,837 | B1 | 7/2001 | Seiler et al. | |
| 6,394,176 | B1 | 5/2002 | Marsais | |
| 6,745,827 | B2 * | 6/2004 | Lee et al. | 165/144 |
| 6,904,963 | B2 * | 6/2005 | Hu | 165/174 |
| 6,973,965 | B2 * | 12/2005 | Meshenky | 165/176 |
| 7,080,683 | B2 * | 7/2006 | Bhatti et al. | 165/177 |
| 2002/0195240 | A1 * | 12/2002 | Kraay et al. | 165/173 |

(Continued)

FOREIGN PATENT DOCUMENTS

DE 195 36 116 A1 4/1997

(Continued)

OTHER PUBLICATIONS

International Search Report for Application Serial No. PCT/US03/13942 dated Aug. 29, 2003.

(Continued)

*Primary Examiner*—Ljiljana Ciric
(74) *Attorney, Agent, or Firm*—Dobrusin & Thennisch PC

(57) ABSTRACT

An improved heat exchanger for an automotive vehicle is disclosed. The heat exchanger typically includes at least one end tank; and a plurality of spaced apart extruded metal tubes with fins between the spaced tubes. The heat exchanger may be single or multi-fluid. In preferred embodiments, the heat exchanger is arranged to have tubes or tube arrangements the improve heat transfer efficiency.

20 Claims, 6 Drawing Sheets

U.S. PATENT DOCUMENTS

| | | | | |
|---|---|---|---|---|
| 2003/0209344 | A1* | 11/2003 | Fang et al. | 165/174 |
| 2004/0134226 | A1* | 7/2004 | Kraay et al. | 62/498 |

FOREIGN PATENT DOCUMENTS

| | | | |
|---|---|---|---|
| EP | 0 632 246 | A | 1/1995 |
| EP | 0 789 213 | A2 | 8/1997 |
| EP | 0 789 213 | A3 | 8/1997 |
| EP | 0 851 198 | A2 | 1/1998 |
| EP | 1 003 005 | A1 | 5/2000 |
| EP | 00851198 | B1 | 3/2003 |
| FR | 2 799 826 | A | 4/2001 |
| JP | 59-205591 | | 11/1984 |
| JP | 59205591 | | 11/1984 |
| JP | 63-197887 | | 8/1988 |
| JP | 63197887 | | 8/1988 |
| JP | 2-230091 | | 9/1990 |
| JP | 02230091 | | 9/1990 |
| JP | 3-79085 | | 8/1991 |
| JP | 4-369396 | | 12/1992 |
| JP | 7-17964 | | 4/1995 |
| JP | 2001-174190 | | 6/2001 |
| JP | 2001174190 | | 6/2001 |

OTHER PUBLICATIONS

Partial International Search Report for Application Serial No. PCT/US03/13955 dated Aug. 22, 2003.
International Search Report for Application Serial No. PCT/US03/13254.
Copending U.S. Appl. No. 60/355,903, filed Feb. 11, 2002.
Copending U.S. Appl. No. 10/140,899, filed May 7, 2002.
Copending PCT Application Serial No. PCT/US03/03985.
International Search Report dated Sep. 27, 2004. PCT/US04/013479. 3 pages.
International Preliminary Examination Report dated Nov. 17, 2005. PCT/US04/013479. 11 pages.
English Abstract for FR2799826. 1 page.

* cited by examiner

HEAT EXCHANGER

FIELD OF THE INVENTION

The present invention relates generally to a heat exchanger and a method of forming the heat exchanger.

BACKGROUND OF THE INVENTION

It is generally desirable for heat exchangers to exhibit efficient transfer of heat. It is also generally desirable for fluids to flow through the heat exchangers without requiring unduly larger pressure drops for driving that flow. Additionally, and particularly in the automotive industry, it has become increasingly desirable to combine multiple functions in a single heat exchanger assembly. Accordingly, the present invention seeks to provide an improved heat exchanger that exhibits one or more of these desirable characteristics.

SUMMARY OF THE INVENTION

The present invention exhibits these characteristics by providing an improved heat exchanger having a first end tank and a second end tank opposite the first end tank. One or more first tubes are in fluid communication with the first and second end tanks and the one or more first tubes are adapted to have a first fluid flow therethrough. One or more second tubes are also in fluid communication with the first and second end tanks and the one or more second tubes are adapted to have the first fluid flow therethrough after the first fluid flows through the one or more first tubes. Although the first and second tubes may be similar or identical to each other, it is preferable that they be different. Preferably, each of the second tubes has a hydraulic diameter greater than about 1.00 mm and each of first tubes preferably has a hydraulic diameter less than about 1.00 mm.

It is further contemplated that the heat exchanger may include one or more third tubes in fluid communication with the first and second end tanks. Preferably, the one or more third tubes are adapted to have a second fluid, different from the first fluid, flow therethrough. Typically, a plurality of fins is disposed between the first tubes, the second tubes, the third tubes or any combination thereof. Preferably, the tubes and the fins are generally co-planar relative to each other although not required.

In one preferred embodiment, the first fluid is a refrigerant such that the first and second tubes are part of a condenser and the second fluid is an oil such that the one or more third tubes are part of an oil cooler. In another preferred embodiment, the one or more third tubes are above the one or more first and second tubes. In another preferred embodiment, the oil cooler includes an inlet supported by the first end tank and the inlet is below an outlet that is also supported by the first end tank. In still another preferred embodiment, the oil cooler is a single pass oil cooler with a lower tube, a higher tube and an inlet located nearer the lower tube than the higher tube. In yet another preferred embodiment, the heat exchanger includes a receiver having a bottom portion located below a lowest tube of the one or more second tubes.

BRIEF DESCRIPTION OF THE DRAWINGS

The features and inventive aspects of the present invention will become more apparent upon reading the following detailed description, claims, and drawings, of which the following is a brief description:

FIG. 13 is an elevational view of another exemplary heat exchanger in accordance with an aspect of the present invention;

DETAILED DESCRIPTION OF THE PREFERRED EMBODIMENT

Figure 1:
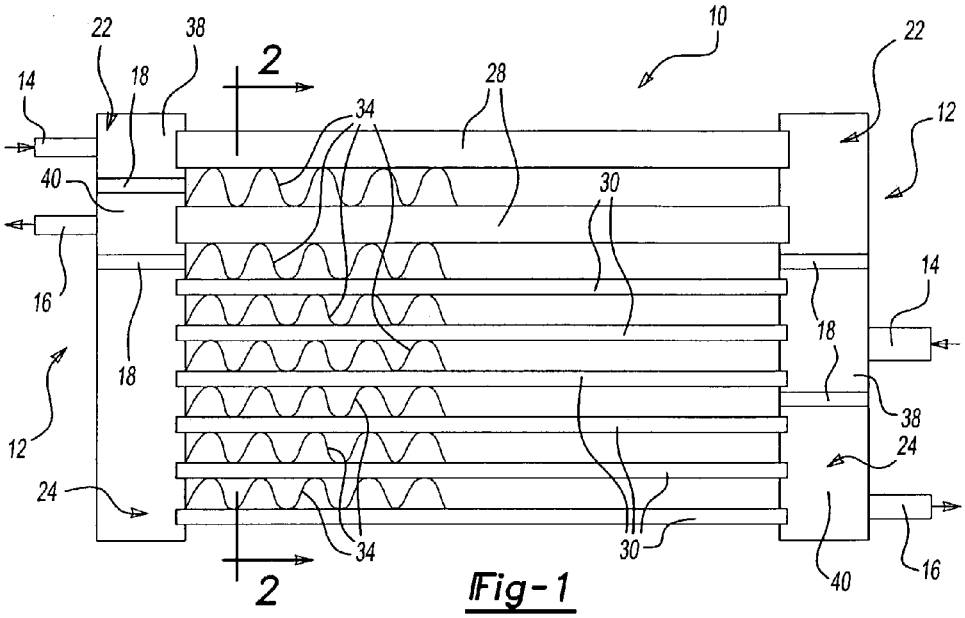
FIG. 1 is an elevational view of an exemplary heat exchanger in accordance with an aspect of the present invention.

Generally, the present invention relates to a heat exchanger and to a method of forming the heat exchanger. The heat exchanger may be a single fluid or multi-fluid (e.g., 2, 3 or 4 fluid) heat exchanger. The heat exchanger may also be a single pass or multi-pass heat exchanger. Although the heat exchanger according to the present invention may be used for a variety of articles of manufacture (e.g., air conditioners, refrigerators or the like), the heat exchanger has been found particularly advantageous for use in automotive vehicles. For example, the heat exchanger may be used for heat transfer of one or more various fluids within a vehicle such as air, oil, transmission oil, power steering oil, radiator fluid, refrigerant, combinations thereof or the like.

According to one embodiment of the invention, the heat exchanger is configured such that a fluid flows through one or more first tubes and then through one or more second tubes wherein the first tubes have a hydraulic diameter that is different (e.g., less than) a hydraulic diameter of the second tubes. Preferably, although not required, the fluid is a refrigerant that is substantially a gas as it enters the one or more first tubes. Advantageously, the embodiment can provide for relatively good heat transfer while assisting in lowering the pressure drop required or desired for flowing the fluid through the first and second tubes.

According to another embodiment, there is contemplated a multi-fluid heat exchanger that includes a condenser in combination with an oil cooler selected from a power steering oil cooler, a transmission oil cooler, a combination thereof or the like. Preferably, the component of the heat exchanger are arranged in a manner that allows for more effective heat exchange, minimal interference between the oil cooler and the condenser, combinations thereof or the like.

The heat exchanger may be installed in a variety of locations relative the article of manufacture to which the heat exchanger is applied. For an automotive vehicle, the heat exchanger is preferably located under a hood of the vehicle. According to one highly preferred embodiment, the heat exchanger may be attached to a radiator of the vehicle. Exemplary methods and assemblies for attaching a heat exchanger to a radiator are disclosed in U.S. Pat. No. 6,158,500 and co-pending U.S. provisional patent application No. 60/355,903, titled "A Method and Assembly for Attaching Heat Exchangers", filed on Feb. 11, 2002 both of which are fully incorporated herein by reference for all purposes.

According to one aspect of the invention, the heat exchanger will comprise a plurality of components that are assembled together by suitable joining techniques. In one preferred embodiment, one or more of the components of the heat exchanger such as the baffles, the end tanks, the tubes, fins, the inlets, the outlets, a bypass or combinations thereof may be attached to each other using brazing techniques. Although various brazing techniques may be used, one preferred technique is referred to as controlled atmosphere brazing. Controlled atmosphere brazing typically employs a brazing alloy for attaching components wherein the components are formed of materials with higher melting points than the brazing alloy. The brazing alloy is preferably positioned between components or surfaces of components to be joined and, subsequently, the brazing alloy is heated and melted (e.g., in an oven or furnace, and preferably under a controlled atmosphere). Upon cooling, the brazing alloy preferably forms a metallurgical bond with the components for attaching the components to each other. According to one highly preferred embodiment, the brazing alloy may be provided as a cladding on one of the components of the heat exchanger. In such a situation, it is contemplated that the components may be formed of a material such as a higher melting point aluminum alloy while the cladding may be formed of a lower melting point aluminum alloy.

Heat exchangers of the present invention will typically include one or more tubes, one or more end tanks, one or more inlets and outlets, one or more baffles, one or more fins or a combination thereof. Depending upon the embodiment of the heat exchanger, various different shapes and configurations are contemplated for the components of the heat exchanger. For example, and without limitation, the components may be integral with each other or they may be separate. The shapes and sizes of the components may be varied as needed or desired for various embodiments of the heat exchanger. Additional variations will become apparent upon reading of the following description.

In general, a preferred heat exchanger contemplates at least two spaced apart end tanks bridged together in at least partial fluid communication by a plurality of generally parallel tubes, with fins disposed between the tubes. Optional end plates, or more preferably, end tubes enclose the assembly in a generally co-planar configuration.

More specifically, referring to FIG. 1, there is illustrated a heat exchanger 10 according to one preferred aspect of the present invention. The heat exchanger 10 includes a pair of end tanks 12. Each of the end tanks includes or supports an inlet 14, an outlet 16 and baffles 18. Of course, it is also possible to locate all inlets, outlets and baffles in only one of the end tanks. Additionally, each of the end tanks 12 includes a first tank portion 22 separated from a second portion 24 by at least one of the baffles 18. The heat exchanger 10 also includes a plurality of tubes 28, 30 extending between the end tanks 12. Preferably, the tubes 28, 30 are separated from each other by fins 34.

Depending upon the configuration of the heat exchanger, it may be possible to provide common end tanks that are divided to accommodate more than one fluid or separate end tanks for accommodating plural fluids. It is also possible that end plates can be employed to bridge the end tanks in accordance with the present invention. However, it is particularly preferred that the heat exchanger employs end tubes in lieu of end plates. In this manner, weight savings and improved efficiency is possible owing to a reduced variety of component types.

As mentioned, one advantageous feature of the present invention is the ability to integrate a plurality of different fluid heat exchangers. Though the specification will make apparent that alternatives are possible (e.g. side by side) one particularly preferred approach is to effectively stack a first fluid heat exchanger upon at least a second fluid heat exchanger in a single generally co-planar assembly.

Figure 2:
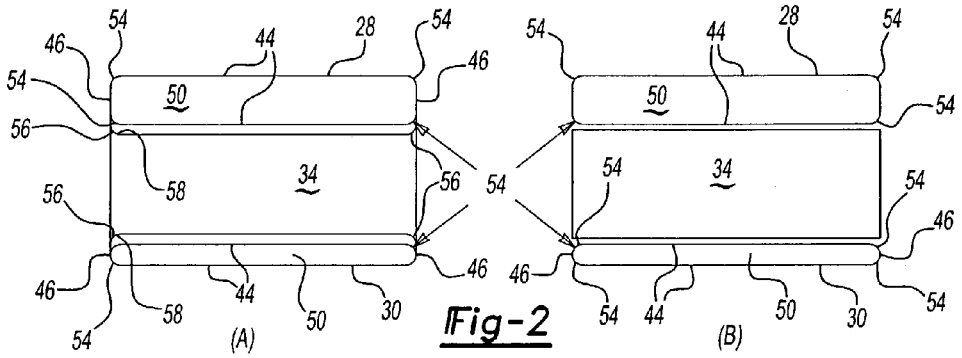
FIG. 2 illustrates sectional views of alternative embodiments of a tube and fin assembly.

In the preferred embodiment shown, the heat exchanger 10 includes a plurality of a first set of tubes 28 extending between and in fluid communication with a first portion 22 (e.g. an upper portion) of the end tanks 12 and a plurality of a second set of tubes 30 in fluid communication with the second portion 24 (e.g. a lower portion) of the end tanks 12. Moreover, the first portion 22 of one of the end tanks 12 and the second portion 24 of the other of the end tanks 12 are separated into an inlet portion 38 in fluid communication with one of the inlets 14 of the heat exchanger 10 and an outlet portion 40 in fluid communication with one of the outlets 16 of the heat exchanger 10. Preferably, as shown best in FIG. 2, the first and second tubes 28, 30 include body walls 44, which are of similar size and shape. However, the first set of tubes 28 preferably include side walls 46 that are substantially larger than corresponding side walls 46 of the second set of tubes 30 such that passageways 50 of the first set of tubes 28 are substantially larger than passageways of the second set of tubes 30.

The heat exchanger 10 is formed by attaching the tubes 28, 30 to the end tanks 22 either sequentially or simultaneously with one or more fins 34 between each of the opposing tubes 28, 30. The tubes 28, 30 may be attached to the end tanks with fasteners (mating or otherwise), by welding, brazing or the like. Additionally, the fins 34 may be attached or fastened to the tubes 28, 30, the end tanks 22 or both.

In a highly preferred embodiment, although not required, the tubes 28, 30 may be formed with arcuate edges 54 connecting the body walls 44 and side walls 46 of the tubes 28, 30. The arcuate edges 54 may be separate from or may form at least part of the body and side walls 44, 46 of the tubes 28, 30. In the preferred embodiment shown, the radius of curvature for each of the arcuate edges 54 is substantially identical. However, the radius may vary from edge to edge. Also in the highly preferred embodiment, the fins 34 are formed with edge projections 56, such as is shown in FIG. 2A. In this manner, the fins are adapted for providing a drop resistant structure that helps retain the fins 34 stable relative to the tubes 28, 30 particularly during assembly (e.g. during a brazing operation). In the preferred embodiment shown, the projections 56 include a surface 58 configured to generally overlap and complement the arcuate edges 54 of the tubes 28, 30. It is contemplated that each fin 34 may include one or a plurality of edge projections 56. For example, as illustrated, there are four projections 56. However, it will be appreciated that fewer may be employed provided that stability of fins relative to tubes can be maintained.

Advantageously, the substantially identically configured body walls 44 and the substantially identical radius of curvature of the edges 54 allows at least one of the larger upper tubes 28 to be separated from at least one of the smaller lower tubes 28, 30 by fins 34 that are substantially identical to the fins 34 separating the lower tubes 28 from each other, the fins 34 separating the upper tubes 28 from each other or both. Thus, in one highly preferred embodiment, each of the tubes 28, 30 is separated from each opposing tube by only one fin 34 and each of the fins 34 is substantially the same size, shape or a combination thereof. Fin size or shape, however, may vary from fin to fin also.

In operation, a first fluid enters through the inlet 14 of the inlet portion 38 of a first of the end tanks 12 and flows through passageways 50 of one or more of the first set of tubes 28 to a first portion of a second of the end tanks 12. Thereafter, the first fluid flows through another passageway 50 of one or more of the first set of tubes 28 to the outlet portion 40 and through the outlet 16. Additionally, a second fluid enters the heat exchanger through the inlet 14 of the inlet portion 38 of the second portion 24 of the second of the end tanks 12 and flows through passageways 50 of the second set of tubes 28. The second fluid flows through the outlet 16 of the second portion 24 of the second of the end tanks 12. Of course, as discussed previously, the functions of both of the end tanks can be integrated into a single end tank.

During flow of the first and second fluids through the tubes 28, 30, an ambient fluid preferably flows by over outside of the tubes 28, 30, the fins 34 or both. In turn, heat may be transferred from the first and second fluids to the ambient fluid or from the ambient fluid to the first and second fluids. The first and second fluids may be of the same or a different viscosity. For example, in one preferred embodiment, the first fluid has a higher viscosity than the second fluid. For example, and without limitation, the first fluid may be transmission oil, coolant oil, engine oil, power steering oil or the like while the second fluid will typically be a refrigerant.

Advantageously, if and when different sized tubes are employed, the larger passageways 50 of the first set of tubes 28 are suitable for the flow of more viscous fluids without relatively large pressure drops across the tubes 28 while the smaller passageways 50 of the lower tubes are suitable for lower viscosity fluids. It is also possible to switch the positioning of the tubes so that the first fluid is passed through the second portion or vice versa.

From the above, it will thus be appreciated that one preferred method of the present invention contemplates providing a multi-fluid heat exchanger assembled in a common assembly; passing a first fluid through one portion of the heat exchanger for heat exchange, and passing at least one additional fluid through at least one additional portion of the heat exchanger for heat exchange of the additional fluid.

It is contemplated that a heat exchanger formed in accordance with the present invention may include one or more tubes having various different internal configurations for defining passageways within the tubes. They may also have different external configurations defining one or more outer peripheral surfaces of the tubes. Further it is possible that the internal configurations, external configuration or both vary along the length of the tube.

It is also contemplated that the tubes may be formed of a variety of techniques and a variety of materials. Exemplary forming techniques include stamping, molding, extrusion, rolling or the like. Exemplary materials include metals such as aluminum, steel, magnesium, titanium, combinations therof or the like or polymeric materials such as plastic, thermoplastics or the like. The internal configuration of a tube may be the same or different from the external configuration. For instance, the walls of the tubes may have opposing sides that are generally parallel to or otherwise complement each other. Alternatively, they may have a different structure relative to each other. The external configuration of the tube may include grooves, ridges, bosses, or other structure along some or all of its length for assisting in heat transfer. Likewise, the internal configuration may include grooves, ridges, bosses or other structure.

It is also possible that the structure is provided for generating turbulence within the fluid, or for otherwise controlling the nature of the flow of fluid there-through.

The passageways of the tubes may be provided in a variety of shapes such as square, rectangular, circular, elliptical, irregular or the like. In preferred embodiments, the passageways of tubes may include one or more partitions, fins or the like. As used herein, a partition for a passageway in a tube is a structure (e.g., a wall) that substantially divides at least part of the passageway into a first and second portion. The partition preferably is continuous (but may be non-continuous) such that the partition completely separates the first portion from the second portion or the partition may include openings (e.g., through-holes, gaps or the like) connecting the first and second portion.

As used herein, a fin for a passageway in a tube is intended to encompass nearly any structure (e.g. a protrusion, a coil, a member or the like), which is located within the passageway of the tube and is physically connected (e.g., directly or indirectly) to an outer surface of the tube that engages in heat exchange. The shape of each of the fins may be the same or different relative to each other. Further, the pitch angle of each fin may be the same or different relative to each other. It will also be appreciated that the configuration of a tube may vary along its length. One or both tube ends may be provided with fins but the central portion left un-finned. Likewise, the central portion may be provided with fins but one or both of the tube ends are left un-finned. Fin spacing may be constant within a passageway or may be varied as desired.

For providing efficient heat transfer, the multi-fluid heat exchanger may be provided in a variety of configurations. For example, tube arrangements, inlet/outlet arrangements, tank arrangements, combinations thereof or the like may be configured to provide added efficiency or other advantages to the heat exchanger. Moreover, additional components may be added to the multi-fluid heat exchanger. Examples of such advantageous configurations are illustrated in FIGS. 3-12.

Figure 3:
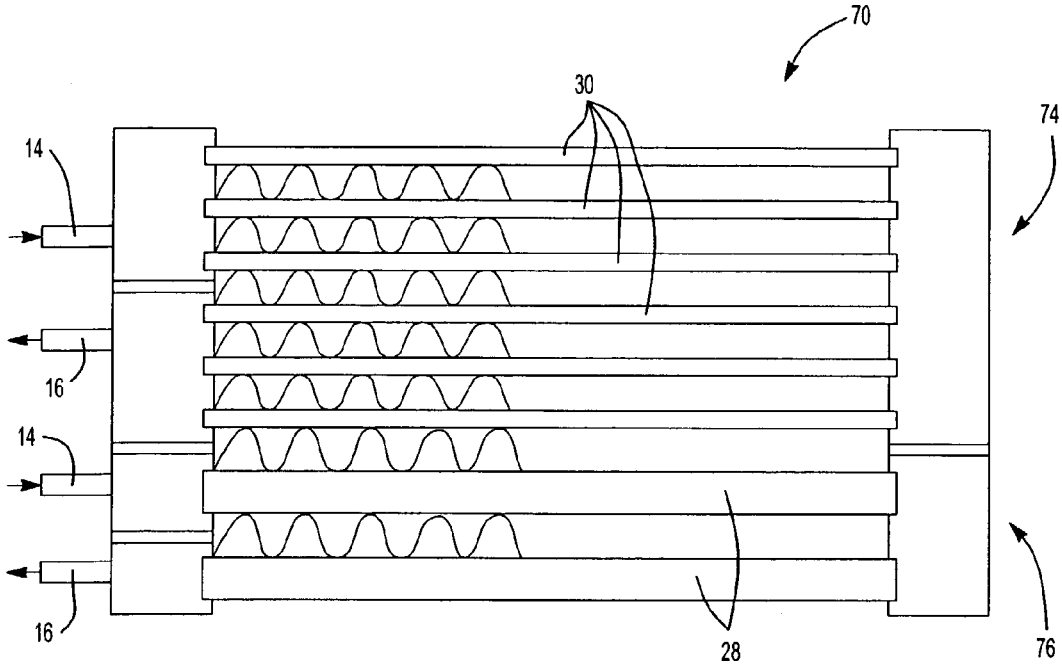
FIG. 3 is an elevational view of another exemplary heat exchanger in accordance with an aspect of the present invention.

Referring to FIG. 3, there is illustrated a multi-fluid heat exchanger 70 that operates in a manner substantially identical to the heat exchanger 10 of FIG. 1. However, in contrast to the exchanger 10 of FIG. 1, the first or larger plurality of tubes 28 of the exchanger 70 of FIG. 3 are below the second or smaller plurality of tubes 30 and the inlet 14/outlet 16 combinations have been placed on one end tank 12. Preferably, the inlet 14 that provides fluid to the first plurality of tubes 28 is in fluid communication with a source of a relatively high viscosity fluid (e.g., an oil such as transmission oil) within an automotive vehicle. It is also preferable for the inlet 14 that provides fluid to the second plurality of tubes 30 be in fluid communication with a source of relatively lower viscosity fluid (e.g., a refrigerant) within the automotive vehicle.

Thus, in the preferred embodiment of FIG. 3, the multi-fluid heat exchanger 70 could be considered to include a condenser 74 and an oil cooler 76. Moreover, upon installation into an automotive vehicle, the condenser 74 is preferably above the oil cooler 76 for providing one or more advantages to the exchanger 70.

As one advantage, the amount of heat exchange provided by the oil cooler 76 may be improved particularly if an opening is provided between the underbody of the automotive vehicle and the oil cooler 76 for promoting air flow past the oil cooler 76. As another advantage, air re-circulation about the condenser 74 may be reduced particularly during idling of the automotive vehicle. As still another advantage, the heat exchanger 70 can improve accessibility of the oil cooler 76 to oil line connections such as a transmission oil line, particularly in instances where the connections are located nearer an underbody or lower portion of the vehicle.

Figure 4:
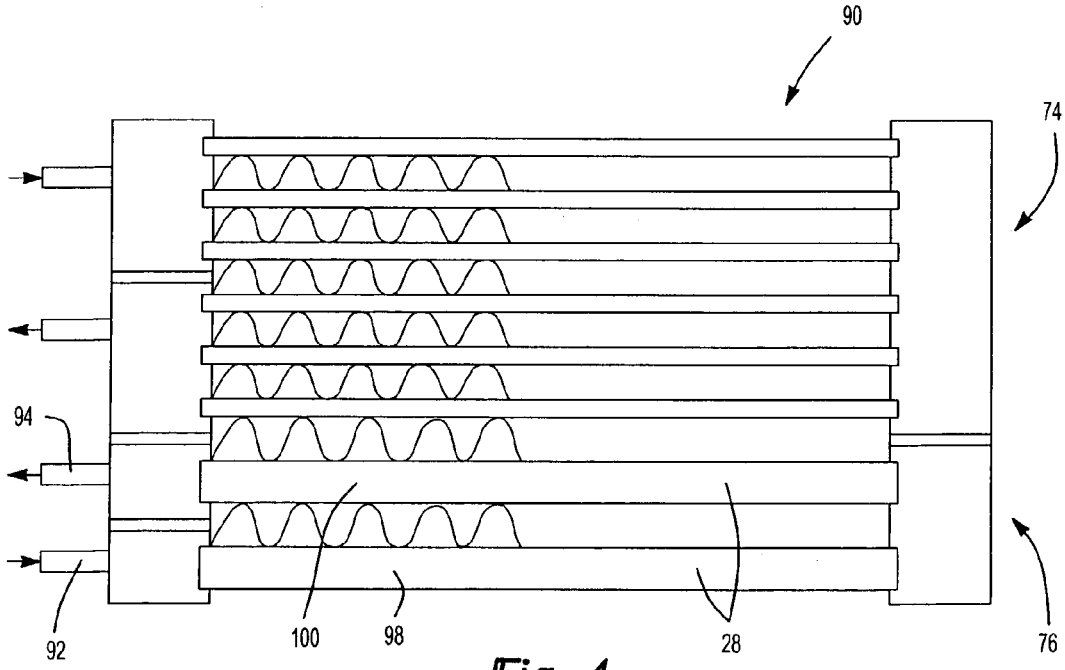
FIG. 4 is an elevational view of another exemplary heat exchanger in accordance with an aspect of the present invention.

Referring to FIG. 4, there is illustrated a multi-fluid heat exchanger 90 substantially identical to the exchanger 70 of FIG. 3 with the exception that an inlet 92 of the oil cooler 76 is positioned below its outlet 94. Thus, the fluid flows through an inlet tube 98 of the plurality of tubes 28 followed by flowing through an outlet tube 100 of the plurality of tubes 28 wherein the outlet tube 100 is closer to the condenser 74 than the inlet tube 98. Advantageously, such an arrangement allows the greater portion of heat transfer to occur during flow through the inlet tube 98 such that the heat transfer is less affected by heat that may be emitted from the condenser 74. Of course, it is contemplated that the oil cooler 76 may have multiple inlet tubes and multiple outlet tubes.

Figure 5:
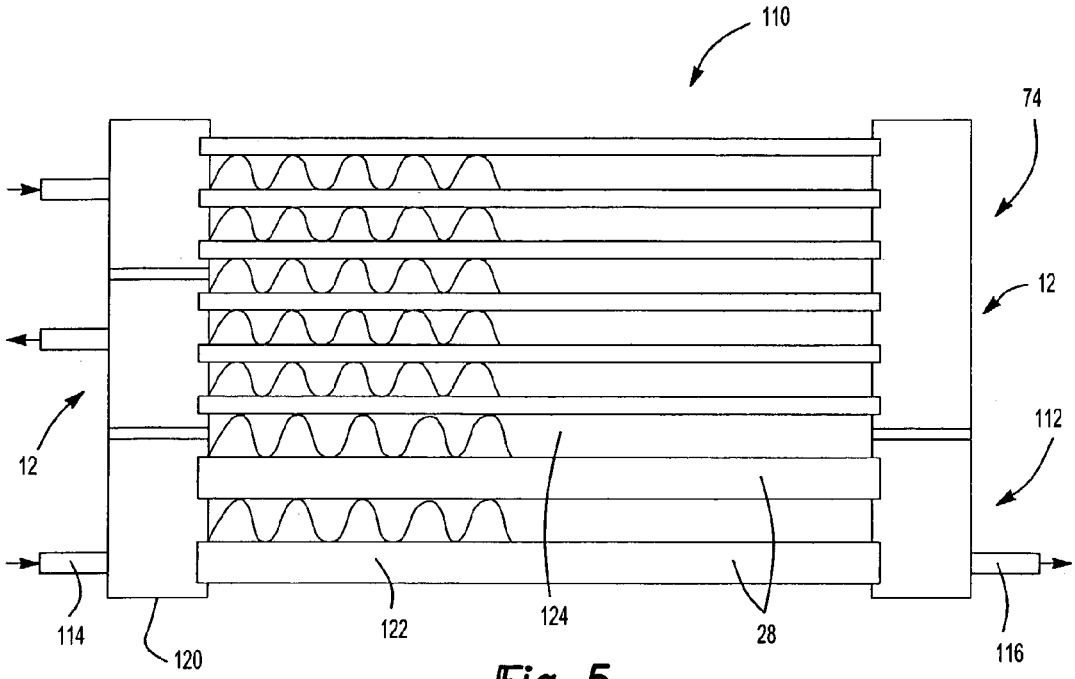
FIG. 5 is an elevational view of another exemplary heat exchanger in accordance with an aspect of the present invention.

Referring to FIG. 5, there is illustrated a multi-fluid heat exchanger 110 similar to the exchanger 90 of FIG. 4, however, the heat exchanger 110 includes a "single pass" oil cooler 112. As such, fluid flows through an inlet 114 located on one of the tanks 12, through the tubes 28 and out through an outlet 116 located on the other of the tanks 12. As shown, the inlet 114 is located adjacent a bottom 120 of the first end tank 12, thereby locating the inlet 114 nearer one or more lower tubes 122 of the plurality of tubes 28 as compared to one or more upper tubes 124 of the plurality of tubes 28. In this manner, fluid flow is increased through the one or more lower tubes 122 relative to the one or more upper tubes 124. Advantageously, such an arrangement allows a greater portion of fluid to flow through the lower tubes so that more heat can be transferred from the fluid that flows through the lower tubes 122. In turn, any effect that heat from the condenser 74 may have on heat transfer from any fluid flowing through the higher tubes 124 is lessened.

Figure 6:
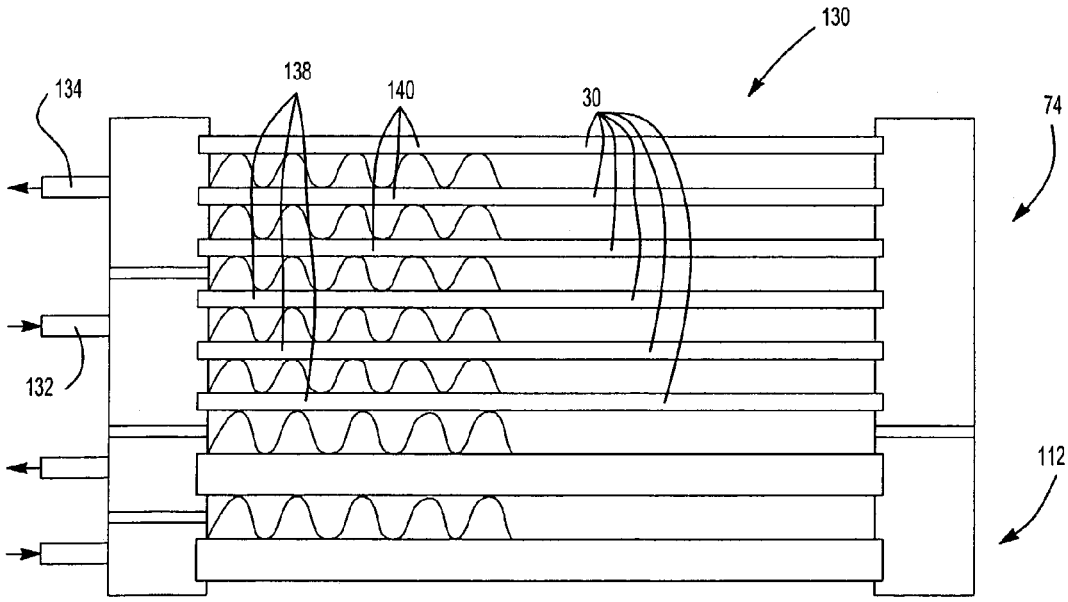
FIG. 6 is an elevational view of another exemplary heat exchanger in accordance with an aspect of the present invention.

Referring to FIG. 6, there is illustrated a multi-fluid heat exchanger 130 substantially identical to the heat exchanger 90 of FIG. 3 with the exception that an inlet 132 of the condenser 74 is positioned below its outlet 134. Thus, the fluid flows through one or more inlet tubes 138 of the plurality of tubes 30 followed by flowing through one or more outlet tubes 140 of the plurality of tubes 30 and, as shown, the inlet tubes 138 are closer to the oil cooler 76 than the outlet tubes 40. Advantageously, such an arrangement allows a greater portion of condenser heat transfer to occur during flow through the outlet tubes 140, if necessary, such that the condenser heat transfer is less affected by heat that may be emitted from the oil cooler 112.

Figure 7:
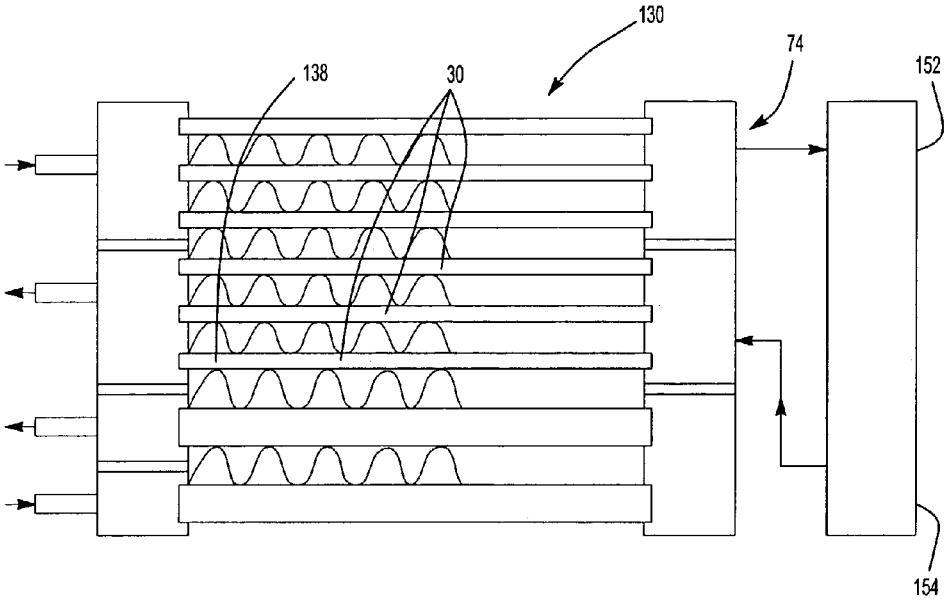
FIG. 7 is an elevational view of another exemplary heat exchanger in accordance with an aspect of the present invention.

Referring to FIG. 7, it is contemplated that the multi-fluid heat exchanger 130 or any heat exchangers disclosed herein can include a receiver 152, which may include a dryer, a filter or both. In the embodiment depicted, the receiver 152 includes a bottom area 154 that is located below a lowest tube 138 of the plurality of tubes 30 of the condenser 74. Advantageously, such a configuration takes advantage of additional space below the condenser 74 for increasing the volume of the receiver 152.

Generally, it should be understood that the embodiments in FIGS. 1-7 may be combined as desired to form a desired heat exchanger. Moreover, FIGS. 8-12, illustrate single fluid exchangers that may be combined according to the configurations of FIGS. 1-7 to form a multi-fluid exchanger or they may remain single fluid exchangers. An example of such a multi-fluid heat exchanger is discussed with reference to FIG. 13.

Figure 8:
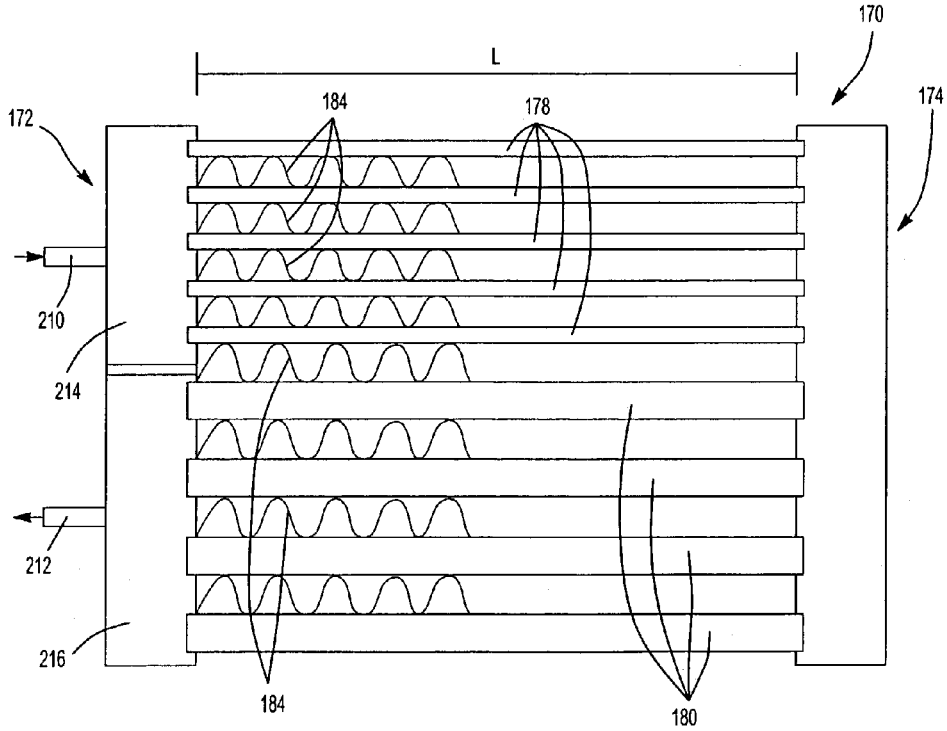
FIG. 8 is an elevational view of another exemplary heat exchanger in accordance with an aspect of the present invention.

Referring to FIG. 8, however, there is illustrated a single fluid heat exchanger 170 according to one preferred aspect of the present invention. The heat exchanger 170 includes a first end tank 172 and a second end tank 174. The heat exchanger 170 also includes a plurality of first tubes 178 and a plurality of second tubes 180 extending between and in fluid communication with the first end tank 172 and the second end tank 174. As shown, fins 184 are positioned between the first tubes 178, between at least one of the first tubes 178 and at least one of the second tubes 180 and between the second tubes 180 although fins may be added or removed as desired.

While it is contemplated that the first tubes 178 and second tubes 180 may be similar or identical to each other, it is preferred that the first tubes 178 are different than the second tubes 180. Preferably, at least one of the first tubes 178 has a hydraulic diameter that is smaller than at least one of the second tubes 80. More preferably, each of the first tubes 78 has a smaller hydraulic diameter than each of the second tubes 80.

The hydraulic diameter of at least one, and preferably, each of the first tubes 178 is less than about 1.0 mm, more preferably less than about 0.8 mm and still more preferably less than about 0.60 mm (e.g., about 0.4 mm). Accordingly, the hydraulic diameter of at least one, and preferably, each of the second tubes 80 is greater than about 1.0 mm, more preferably greater than about 1.2 mm and even more preferably greater than about 1.3 mm (e.g., about 1.4 mm).

As used herein, hydraulic diameter ($D_h$) is determined according to the following equation:

$$D_h=4A_P/P_w$$

wherein $A_p$=wetted cross-sectional are of the passageway of a tube; and $P_w$=wetted perimeter of the tube.

Each of the variables ($P_w$ and $A_p$) for hydraulic diameter ($D_h$) are determinable for a tube according to standard geometric and engineering principles and will depend upon the configuration of a particular tube, surface roughness of inner tube walls and the aforementioned tube variables (i.e., the number of partitions, the number of portions, the size of the portions, the size of the passageways or a combination thereof).

Preferably, the plurality of first tubes 178 includes at least one, two or three more tubes 178 than the plurality of second tubes 180. As shown, the plurality of first tubes 178 includes five tubes 178, but may include fewer (e.g., two, three or four) or more (e.g., six, seven or more) tubes 178. The plurality of second tubes 180 includes four tubes 180, but may include fewer (e.g., two or three) or more (e.g., five, six or more) tubes 180. It is also contemplated that the heat exchanger 170 may include only one first tube 178, only one second tube 180 or both and that there may be fewer second tubes 180 as compared to first tubes 178.

Preferably, each of the plurality of first tubes 178 is substantially identical to the other first tubes 178 and each of the plurality of second tubes 180 is substantially identical to the other second tubes 180. It is contemplated however, that one or more of the first tubes 178 may be different from each other or one or more of the second tubes 180 may be different from each other. For example hydraulic diameters, geometries or the like may be different.

Figure 9:
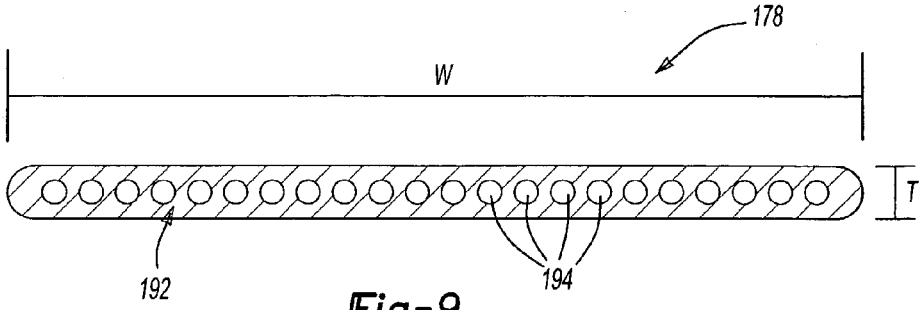
FIG. 9 is a sectional view of an exemplary tube suitable for the heat exchanger of FIG. 8.

With additional reference to FIG. 9, there is illustrated an exemplary cross-section of a preferred first tube 178 having a passageway 192 divided into a plurality of sub-passageways 194. Dimensionally, the tube 178 has a length (L), a width (W) and a thickness (T). Preferably, the length (L) is between about 15 cm and 90 cm and more preferably between about 20 cm and about 70 cm. The width (W) is preferably between about 5.0 mm and about 30 mm, more preferably between about 10 mm and about 22 mm and even more preferably between about 14 mm and about 18 mm. The thickness (T) is preferably between about 0.4 mm and about 3.0 mm, more preferably between about 0.7 mm and about 1.5 mm and even more preferably between about 0.9 mm and about 1.2 mm.

As shown, there are twenty two sub-passageways 194 that are substantially cylindrical in shape. Also, the sub-passageways 194 are illustrated as substantially round (e.g., circular) in cross-section. It is contemplated, however, that the shape of the sub-passageways may be varied as needed or desired, that the shape may be varied from sub-passageway to sub-passage and that there may be greater of fewer sub-passageways.

Preferably, the sub-passageways 194 are each dimensioned to have a cross-sectional area perpendicular to the length (L) that is between about 0.02 $mm^2$ and about 1.00 $mm^2$, more preferably between about 0.13 $mm^2$ and about 0.60 $mm^2$. It is contemplated, however, that the dimensions may be different from those mentioned.

Figure 10:
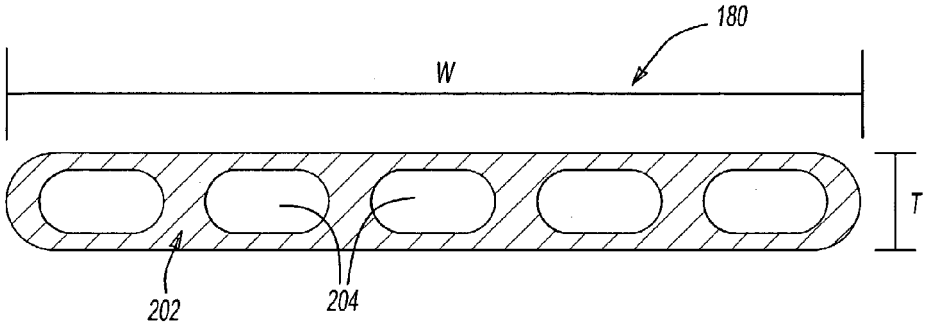
FIG. 10 is a sectional view of another exemplary tube suitable for the heat exchanger of FIG. 8.

Additionally referring to FIG. 10, there is illustrated an exemplary cross-section of a preferred second tube 180 having a passageway 202 divided into a plurality of sub-passageways 204. Dimensionally, like the first tube 178, the second tube 180 has a length (L), a width (W) and a thickness (T). Preferably, the length (L) is the same or similar to the length of the first tube 178 and is between about 15 cm and 90 cm and more preferably between about 20 cm and about 75 cm. The width (W) is also preferably the same or similar to the width of the first tube 178 and is between about 5.0 mm and about 30 mm, more preferably between about 10 mm and about 22 mm. The thickness (T) of the second tube 178 is preferably between about 0.6 mm and about 4.0 mm, more preferably between about 1.1 mm and about 2.5 mm and even more preferably between about 1.3 mm and about 1.8 mm.

As shown, there are five sub-passageways 204 and the sub-passageways 204 are illustrated as substantially oblong (e.g., elongated round or circular) in cross-section. It is contemplated, however, that the shape of the sub-passageways may be varied as needed or desired, may be varied from sub-passageway to sub-passageway and that there may be greater of fewer sub-passageways.

Preferably, the sub-passageways 204 are each dimensioned to have a cross-sectional area perpendicular to the length (L) that is between about 1.00 $mm^2$ and about 5.00 $mm^2$, more preferably between about 1.2 $mm^2$ and about 3.0 $mm^2$. It is contemplated, however, that the dimensions may be different from those mentioned.

In addition to varying the shapes, cross-sections, dimensions or the like of the tubes 178, 180, the surface roughness of inner walls of tubes 178, 180 that define the sub-passageways 194, 204 may also be varied. For example, the inner walls may be smooth, corrugated, contoured or the like. Advantageously, varying such roughness can assist in fine tuning the hydraulic diameters of the tubes as needed or desired. Preferably, the first end tank 172, the second end tank 174 or a combination thereof include at least one inlet 210 and at least one outlet 212 for respectively receiving and emitting a fluid. It is contemplated, however, that the inlet 210 and the outlet 212 may be alternatively located depending upon design considerations for a heat exchanger.

In operation, a fluid flows through the inlet 210 into the first end tank 172. In the particular embodiment shown, the first end tank 172 is divided into an inlet portion 214 and an outlet portion 216 and the fluid flows into the inlet portion 214. Thereafter, the fluid flows through the plurality of first tubes 178 to the second end tank 174.

During flow through the plurality of first tubes 178, it is preferable, although not required, that a substantial amount (e.g., more than 30%, 50% or 80% by weight) of the fluid change from a gas phase to a liquid phase. For facilitating such phase change, it is preferable that the fluid is a refrigerant such as those known to the skilled artisan as R134a and R22. It is contemplated, however, that any other suitable fluids (e.g., water, oil or the like) may be used.

Once in the second tank 174, the fluid flows through the plurality of second tubes 180 to the outlet portion 216 of the of the first end tank 172. Preferably, the fluid remains in the liquid phase or more of the fluid becomes liquid during flow through the plurality of second tubes 180. Then the fluid flows through the outlet 212 to exit the heat exchanger 170.

In the preferred embodiment illustrated, at least a portion and preferably substantially all of the fluid must flow through at least one of the plurality of first tubes 178 and, thereafter, must flow through at least one of the plurality of second tubes 180. In alternative embodiments, however, it is contemplated that one or more bypasses (e.g., tubes, passageways or the like) may be employed such that a portion of the fluid does not flow through any of the first tubes 178, any of the second tubes 180 or both. It is also contemplated that the flow pattern described above may be altered.

For flowing the fluid through the tubes 178, 180 and end tanks 172, 174, a particular total pressure drop $\Delta P_{tot}$ is typically required to drive the fluid from the inlet 210 or inlet portion 214 to the outlet 212 or outlet portion 216. Generally speaking, it is preferable to maintain that pressure drop $\Delta P_{tot}$ below a certain predetermined amount for nearly all heat exchanger applications. Moreover, maintaining a relatively low $\Delta P_{tot}$ is particularly desirable for automotive applications such as for automotive condensers.

In the embodiment shown, the total pressure drop $\Delta P_{tot}$ is typically substantially equivalent to the sum of the pressure drop $\Delta P_1$ across the plurality of first tubes 178 and the pressure drop $\Delta P_2$ across the plurality of second tubes 180. Of course, in alternative embodiments, the total pressure drop $\Delta P_{tot}$ may be minorly or more significantly effected by other pressure drops as well (e.g., from bypasses, additional tubes or the like).

Either way, the combination of the first tubes 178 and the second tubes 180 into the heat exchanger 170 advantageously can allow for greater heat exchange of lower total pressure drops $\Delta P_{tot}$ when compared with traditional heat exchangers. As examples, it is contemplated that the total pressure drop $\Delta P_{tot}$ may be less than 1.5 bar and more preferably less than 1.0 bar. Exemplary pressure drops $\Delta P_1$ across the first tubes 178 may be less than 0.75 bar and more preferably less than 0.5 bar. Moreover, exemplary pressure drops $\Delta P_2$ across the plurality of second tubes 80 may be less than about 0.75 bar and more preferably less than 0.5 bar. Of course, larger pressure drops may also be considered within the scope of the present invention.

Figure 11:
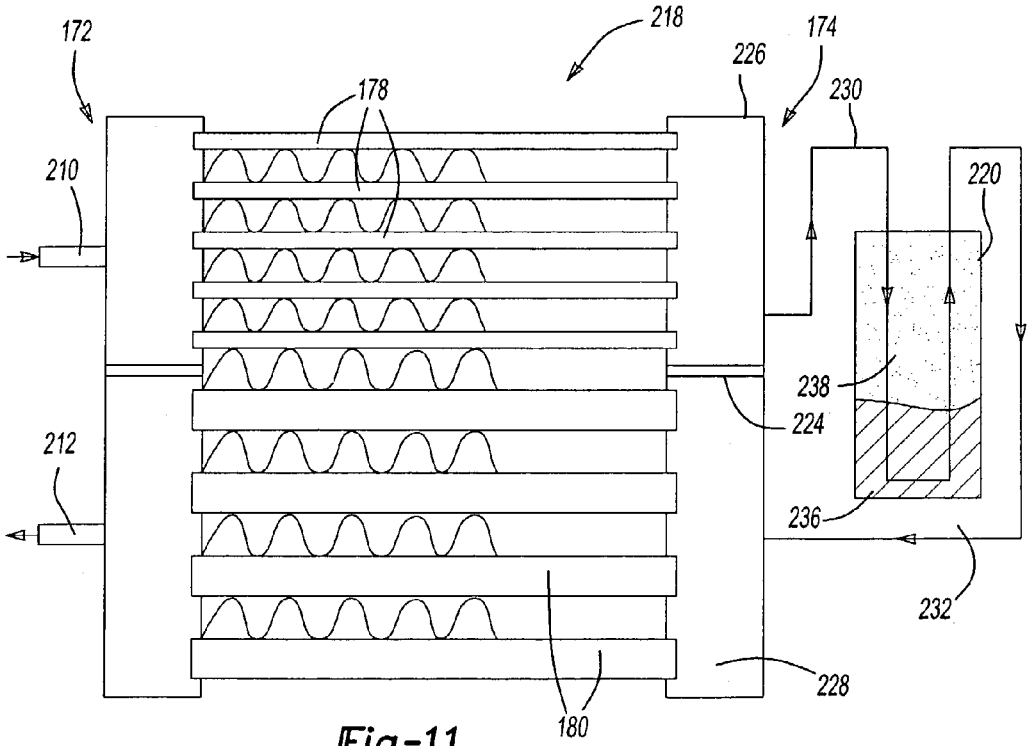
FIG. 11 is an elevational view of another exemplary heat exchanger in accordance with an aspect of the present invention.

In alternative embodiments, the heat exchanger of the present invention may include or be operated in conjunction with additional components such as bypasses, pumps or the like. Referring to FIG. 11, a heat exchanger 218 substantially identical to the heat exchanger 170 of FIG. 8 has been adapted to include a receiver 220, which may or may not include a dryer (not shown), a filter (not shown) or both. As shown, the heat exchanger 218 includes substantially the same inlet 210, outlet 212, end tanks 172, 174 and tubes 178, 180. Additionally, however, an additional baffle 224 has been secured within the second end tank 174 to assist in guiding the fluid through the receiver 220. As shown, the baffle 224 divides the second end tank 174 into a first portion 226 and a second portion 228.

For the heat exchanger 218 shown in FIG. 11, the fluid flows as described with respect to the heat exchanger 170 of FIG. 8 with the exception that the fluid flows from the plurality of first tubes 178 into only the first portion 226 of the second end tank 174 and from the first portion 226 of the end tank 174 through a first passageway 230 into the receiver 220. Thereafter, the fluid flows from the receiver 220 through a second passageway 232 into the second portion 228 of the second tank 174 and then through the plurality of second tubes 280.

In a preferred embodiment, during fluid flow, the receiver 120 can act as a separator, which separates any portion of the fluid in a liquid state from any portion of the fluid in a gas state. As shown in FIG. 11, the fluid 236 in a liquid state tends to settle at a lower portion of the receiver 220 than the fluid 238 in a gas state. Thus, the second passageway 232 can be provided such that flow of fluid 236 in the liquid state is allowed to flow through the second passageway 232 while fluid 238 in the gas state is substantially restricted from flowing through the second passageway 232.

In this manner, substantially all of the fluid that enters the second portion 228 of the second end tank 174 and then flows into the plurality of second tubes 180 is in a fluid state. As such, a relatively low amount of cooling is typically required of the plurality of second tubes 180 to maintain the fluid in the liquid state. In turn, the second tubes 180 may have even greater hydraulic diameters resulting in a lower pressure drop $\Delta P_2$ across the plurality of second tubes 180 thereby allowing a smaller total pressure drop $\Delta P_{tot}$.

Exemplary hydraulic diameters for the plurality of second tubes 180 of FIG. 11 may be greater than about 1.0 mm and even more preferably greater than about 1.3 mm. Exemplary pressure drops $\Delta P_2$ across the plurality of second tubes 180 may be less than 0.75 bar and more preferably less than 0.50 bar. Of course lower hydraulic diameters and higher pressure drops are still considered within the scope of the invention.

Figure 12:
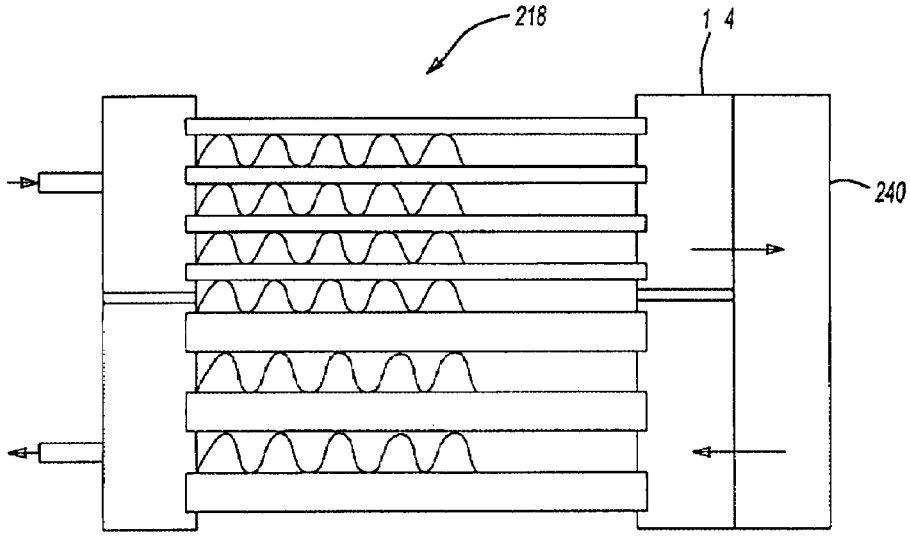
FIG. 12 is an elevational view of another exemplary heat exchanger in accordance with an aspect of the present invention.
Figure 1:
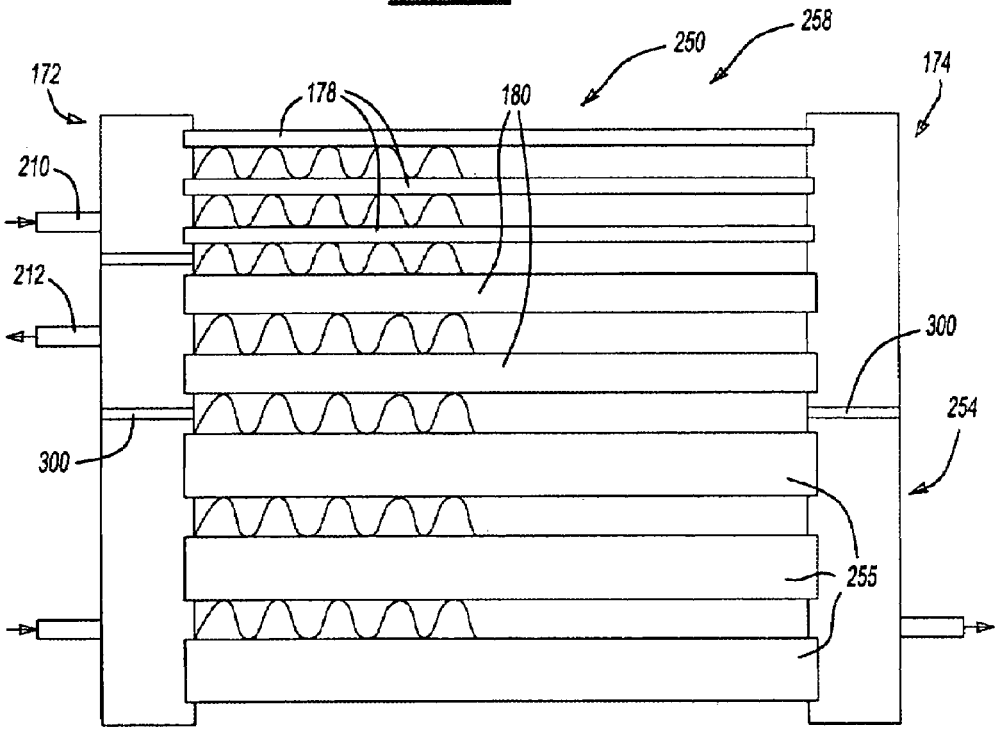

Referring to FIG. 12, it is contemplated that a receiver 240 that is functionally equivalent to the receiver 220 of FIG. 11 may be attached to or integrated with the second end tank 174 of the heat exchanger 218. As such, the receiver 240 may be mechanically fastened to the end tank 174 with fasteners, by welding or the like. Alternatively, the receiver 240 may also be integrally formed with the end tank 174.

Referring to FIG. 13, it is contemplated that a heat exchanger 250 such as the heat exchangers 170, 218 of FIGS. 8-11 may be attached to, or integrated with another heat exchanger 254 (e.g., an oil cooler or the like) to form a multi-fluid heat exchanger 258 such as the multi-fluid heat exchanger 10 of FIG. 1. As illustrated in FIG. 13, the heat exchanger 250 includes one or more first tubes 178, one or more second tubes 180, end tanks 172, 174, an inlet 210 and an outlet 212 like the heat exchangers 170, 218 of FIGS. 8-11. Additionally, the second heat exchanger 254 includes one or more tubes 255 in fluid communication with the end tanks 172, 174 for flowing a second fluid therethrough. As can be seen, baffles 300 are included in the end tanks 172, 174 for preventing fluid flow between the heat exchangers 250 and 254.

Generally, it is contemplated that the various concepts components and heat exchangers disclosed for the present invention may be combined with each other as desired. Also various other concepts, components and heat exchangers may be combined with the concepts, components, and heat exchangers disclosed for the present invention. Examples of heat exchangers, components and concepts, which may be employed in combination with the heat exchangers, components and concepts of the present invention are disclosed in U.S. patent application Ser. No. 10/140,899, filed on May 7, 2002, titled "Improved Heat Exchanger" and expressly incorporated herein by reference for all purposes.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heat exchanger comprising:

a first end tank;

a second end tank opposite the first end tank;

a first tube in fluid communication with the first and second end tanks, the first tube adapted to have a first fluid flow therethrough, the first tube having a hydraulic diameter less than 1.00 mm, the first tube defining a plurality of sub-passageways extending along a length of the first tube wherein each of the sub-passageways of the first tube has a cross-sectional area perpendicular to the length of the first tube that is between about 0.02 $mm^2$ and about 1.00 $mm^2$;

a second tube in fluid communication with the first and second end tanks, the second tube also being in fluid communication with the first tube such that the first fluid, during operation of the heat exchanger, flows through the second tube after the first fluid flows through the first tube, the second tube having a hydraulic diameter greater than 1.00 mm; and at least one fin contacting the first tube and the second tube, with the first tube and second tube and the at least one fin being generally co-planar relative to each other.

2. A heat exchanger as in claim 1 wherein the hydraulic diameter of the first tube is less than 0.8 mm.

3. A heat exchanger as in claim 2 wherein the hydraulic diameter of the second tube is greater than 1.2 mm.

4. A heat exchanger as in claim 1 wherein the second tube defines a plurality of sub-passageways extending along a length of the second tube wherein each of the sub-passageways of the second tube have a cross-sectional area perpendicular to the length of the second tube that is between about 1.1 $mm^2$ and about 2.2 $mm^2$.

5. A heat exchanger as in claim 1 wherein the first fluid is a refrigerant.

6. A heat exchanger as in claim 1 further comprising a receiver in fluid communication with the second end tank for receiving fluid from the first tube and providing fluid to the second tube.

7. A heat exchanger as in claim 6 wherein the receiver at least partially separates a portion of the first fluid in a liquid state from a portion of the first fluid in a gas state.

8. A heat exchanger comprising:

a first end tank;

a second end tank opposite the first end tank;

a plurality of first tubes in fluid communication with the first and second end tanks, the plurality of first tubes adapted to have a first fluid flow therethrough, the plurality of first tubes each having a hydraulic diameter less than 1.00 mm;

a plurality of second tubes in fluid communication with the first and second end tanks, the plurality of second tubes also being in fluid communication with the first tube such that the first fluid, during operation of the heat exchanger, flow through the plurality of second tubes after the first fluid flows through the plurality of first tubes, the plurality of second tubes each having a hydraulic diameter greater than 1.00 mm, each first tube defining a plurality of sub-passageways extending along a length of each first tube wherein each of the sub-passageways of each first tube has a cross-sectional area perpendicular to the length of each first tube that is between about 0.02 $mm^2$ and about 1.00 $mm^2$.

at least one fin contacting at least one of the plurality of first tubes and at least one of the plurality of second tubes, with the plurality of first tubes and the plurality of second tubes and the fins being generally co-planar relative to each other.

9. A heat exchanger as in claim 8 wherein the hydraulic diameter of each first tube is less than 0.6 mm.

10. A heat exchanger as in claim 9 wherein the hydraulic diameter of each second tube is greater than 1.2 mm.

11. A heat exchanger as in claim 8 wherein each second tube defines a plurality of sub-passageways extending along a length of each second tube wherein each of the sub-passageways of each second tube has a cross-sectional area perpendicular to the length of each second tube that is between about 1.1 $mm^2$ and about 2.2 $mm^2$ .

12. A heat exchanger as in claim 8 wherein the first fluid is a refrigerant.

13. A heat exchanger as in claim 8 further comprising a receiver in fluid communication with the second end tank for receiving fluid from the plurality of first tubes and providing fluid to the plurality of second tubes.

14. A heat exchanger as in claim 13 wherein the receiver at least partially separates a portion of the first fluid in a liquid state from a portion of the first fluid in a gas state.

15. A heat exchanger comprising:

a first end tank;

a second end tank opposite the first end tank;

a plurality of first tubes in fluid communication with the first and second end tanks, the plurality of first tubes adapted to have a first fluid flow therethrough, the plurality of first tubes having a hydraulic diameter less than 1.00 mm;

a plurality of second tubes in fluid communication with the first and second end tanks, the plurality of second tubes also being in fluid communication with the first tube such that the first fluid, during operation of the heat exchanger, flows through the plurality of second tubes after the first fluid flows through the plurality of first tubes, the plurality of second tubes each having a hydraulic diameter greater than 1.00 mm;

a plurality of third tubes in fluid communication with the first and second end tanks, with but not in fluid communication with the pluralities of first and second tubes, such that a second fluid, different from the first fluid, flows through the plurality of third tubes during operation of the heat exchanger; and a plurality of fins disposed between the pluralities of first, second and third tubes, with the pluralities of first, second and third tubes and the plurality of fins being generally co-planar relative to each other.

16. A heat exchanger as in claim 15 wherein the first fluid is a refrigerant such that the first and second plurality of tubes are part of a condenser and the second fluid is an oil such that the plurality of third tubes are part of an oil cooler.

17. A heat exchanger as in claim 16 wherein the plurality of third tubes are above the plurality of first tubes and the plurality of second tubes.

18. A heat exchanger as in claim 16 wherein the oil cooler includes an inlet supported by the first end tank below an outlet that is also supported by the first end tank.

19. A heat exchanger as in claim 16 wherein the oil cooler is a single pass oil cooler with a lower tube, a higher tube and an inlet located nearer the lower tube than the higher tube.

20. A heat exchanger as in claim 16 further comprising a receiver having a bottom portion located below a lowest tube of the plurality of second tubes.

* * * * *

UNITED STATES PATENT AND TRADEMARK OFFICE

CERTIFICATE OF CORRECTION

PATENT NO. : 7,337,832 B2
APPLICATION NO. : 10/425348
DATED : March 4, 2008
INVENTOR(S) : Zaiqian Hu It is certified that error appears in the above-identified patent and that said Letters Patent is hereby corrected as shown below:

In Col. 13, line 47
replace "fins"
with -- at least one fin. --

In Col. 14, line 39 and 40
replace "first and second plurality of tubes"
with -- plurality of first tubes and the plurality of second tubes. --

Signed and Sealed this

Thirtieth Day of September, 2008

JON W. DUDAS
*Director of the United States Patent and Trademark Office*